US012480285B2

(12) United States Patent
Currier

(10) Patent No.: US 12,480,285 B2
(45) Date of Patent: Nov. 25, 2025

(54) REPOSE-OPTIMIZED MATERIAL STOCKPILING TOOL PATH

(71) Applicant: Caterpillar Inc., Peoria, IL (US)

(72) Inventor: Shaun David Currier, Naperville, IL (US)

(73) Assignee: Caterpillar Inc., Peoria, IL (US)

( * ) Notice: Subject to any disclaimer, the term of this patent is extended or adjusted under 35 U.S.C. 154(b) by 125 days.

(21) Appl. No.: 18/429,518

(22) Filed: Feb. 1, 2024

(65) Prior Publication Data

US 2025/0250772 A1 Aug. 7, 2025

(51) Int. Cl.
*E02F 9/26* (2006.01)
*E02F 3/43* (2006.01)

(52) U.S. Cl.
CPC ..... *E02F 9/262* (2013.01); *E02F 3/434* (2013.01)

(58) Field of Classification Search
CPC ..... E02F 9/262; E02F 3/434
See application file for complete search history.

(56) References Cited

U.S. PATENT DOCUMENTS

| | | | | |
|---|---|---|---|---|
| 8,160,783 | B2 | 4/2012 | Shull | |
| 8,204,653 | B2 | 6/2012 | Sahlin et al. | |
| 8,280,596 | B2 * | 10/2012 | Hagenbuch | G06F 30/15 701/50 |
| 8,527,155 | B2 * | 9/2013 | Gudat | E02F 9/2054 701/50 |
| 9,587,369 | B2 | 3/2017 | Fletcher et al. | |
| 11,174,618 | B2 * | 11/2021 | Currier | E02F 9/264 |
| 11,346,086 | B1 | 5/2022 | Kikani et al. | |
| 2018/0347154 | A1 | 12/2018 | Martinsson et al. | |

* cited by examiner

*Primary Examiner* — Tyler J Lee

(57) ABSTRACT

A method and system for controlling a machine to adjust the angle of repose of a material pile by receiving, by one or more processors and from sensors, measurements of geometric characteristics of a material pile; determining an actual angle of repose for the pile; identifying properties of the material; determining, by the one or more processors, a target angle of repose for the material pile according to the one or more material properties; determining an optimized travel path for a tool through the material pile, according to the actual and target angle of repose; and causing the tool to be actuated along the optimized travel path, wherein the tool engages and lifts a portion of the material to a top of the material pile such that the remaining material of the material pile has an angle of repose that is substantially equal to the target angle of repose.

22 Claims, 4 Drawing Sheets

REPOSE-OPTIMIZED MATERIAL STOCKPILING TOOL PATH

TECHNICAL FIELD

The present disclosure relates generally to the field of movement of materials by heavy machinery, specifically to systems and methods to assist operators of heavy machinery moving materials.

BACKGROUND

In material stockpiling applications, the operator of a heavy machine such as a front loader is tasked with piling materials on a worksite or other location. Typically, the materials are loose and granular. For example, materials may include soil, gravel, sand or mixtures. Such materials have a natural angle of repose. Piling of materials such that the piles are close to the natural angle of repose of the material may allow an operator to produce higher piles that are more efficient in terms of worksite surface area. Short or collapsed piles are inefficient and occupy more surface area of the worksite than is necessary, thereby reducing over storage volume for the worksite.

Efficient stockpiling of materials can also reduce wear and tear on the machine. When scooping and moving materials like gravel, rocks, or abrasive substances, the constant contact and movement against the machine's engagement tool, arms, and other components can cause abrasion or other wear on the components. Over time, friction can lead to wear and tear on the machine's engagement surfaces and lift mechanisms. Continuous piling of heavy or bulky materials may strain the machine's hydraulic system and engagement tools, for example. Inefficient stockpiling can result in the need for repeated stockpiling sweeps in order to properly shape the material pile. Further, the use of incorrect techniques by an operator, such as sudden movements or excessive force when handling materials, can cause unnecessary stress and wear on the machine.

SUMMARY

In a first aspect, provided herein is a method of controlling a machine to efficiently. In some embodiments, the method includes: receiving, by one or more processors and from one or more sensors, measurements indicative of one or more geometric characteristics of a material pile; determining, by the one or more processors, an actual angle of repose for a material of the material pile according to the geometric characteristics of the material pile; identifying one or more material properties of the material; determining, by the one or more processors, a target angle of repose for the material pile according to at least one of a maximum value of the actual angle of repose or the one or more material properties; determining, by the one or more processors, an optimized travel path for a tool through a portion of the material pile, according to the actual angle of repose and the target angle of repose for the material; and causing the tool to be actuated along at least a first portion of the optimized travel path, wherein the tool, when actuated, engages a portion of the material of the material pile and lifts the portion of the material to a top of the material pile such that the remaining material of the material pile has an angle of repose that is substantially equal to the target angle of repose.

In another aspect, provided herein is a system for efficient stockpiling of materials. In some embodiments, the system includes: a control circuit comprising one or more processors and memory structured to store instructions that, when executed by the one or more processors, cause the control circuit to: receive, by one or more processors, measurements from a sensor indicative of one or more geometric characteristics of a material pile; determine, by the one or more processors, an actual angle of repose for a material of the material pile according to the geometric characteristics of the material pile; identify, by the one or more processors, one or more material properties of the material; determine, by the one or more processors, a target angle of repose for the material pile according to the one or more material properties; calculate, by the one or more processors, an optimized travel path for a tool through a portion of the material pile according to the actual angle of repose and the target angle of repose for the material; and cause the tool to be actuated along at least a first portion of the optimized travel path, wherein the tool, when actuated, engages a portion of the material of the material pile and lifts the portion of material to a top of the material pile such that the remaining material of the material pile has an angle of repose that is substantially equal to the target angle of repose.

In another aspect, provided herein is a system including: a tool configured to lift a material from a material pile; a sensor configured to measure an actual angle of repose of the material pile; a control circuit comprising one or more processors and memory structured to store instructions that, when executed by the one or more processors, cause the control circuit to: receive, by one or more processors from one or more sensors, measurements indicative of one or more geometric characteristics of a material pile; determine, by the one or more processors, an actual angle of repose for a material of the material pile according to the geometric characteristics of the material pile; identify one or more material properties of the material; determine, by the one or more processors, a target angle of repose for the material pile according to the one or more material properties; calculate, by the one or more processors, an optimized travel path for a tool through a portion of the material pile according to the actual angle of repose and the target angle of repose for the material; and cause the tool to be actuated along at least a first portion of the optimized travel path, wherein the tool, when actuated, engages a portion of the material of the material pile and lifts the portion of material to a top of the material pile such that the remaining material of the material pile has an angle of repose that is substantially equal to the target angle of repose.

DETAILED DESCRIPTION

Before turning to the figures, which illustrate certain embodiments in detail, it should be understood that the present disclosure is not limited to the details or methodology set forth in the description or illustrated in the figures.

It should also be understood that the terminology used herein is for the purpose of description only and should not be regarded as limiting.

Machine

Figure 1:
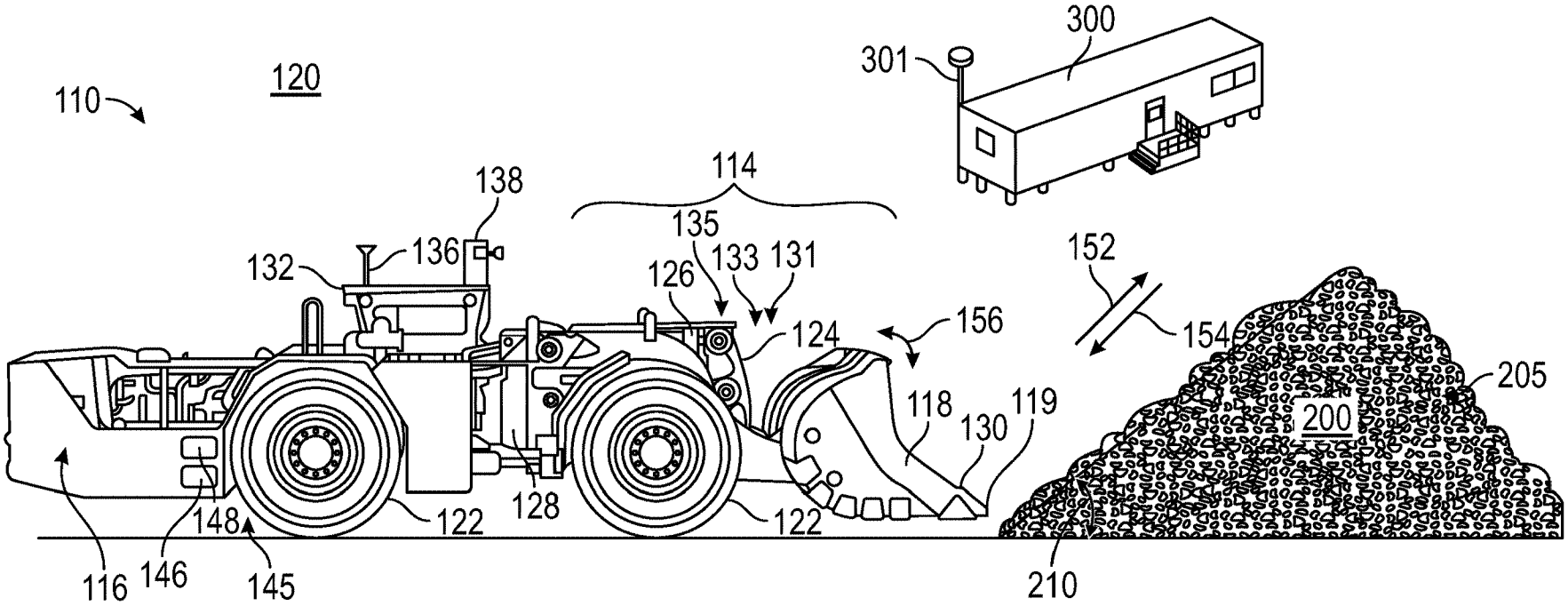
FIG. 1 is a diagram of a machine and a material pile, according to an embodiment.

FIG. 1 illustrates an exemplary machine 110 having multiple systems and components that cooperate to move and stockpile material 205. In the disclosed example, the machine 110 is a load-haul-dump machine (LHD). It is contemplated, however, that the machine 110 could embody another type of earth-moving machine (e.g., a front loader, a track loader, a wheel loader, or a carry dozer), if desired.

The machine 110 may include, among other things, an implement system 114 and a powertrain 116. The implement system 114 may be driven by the powertrain 116 to repetitively move a work tool 118 during completion of a stockpiling operation, which is discussed in more detail below. The powertrain 116, in addition to driving the implement system 114, may also function to propel machine 110, for example via one or more traction devices (e.g., wheels or tracks) 122.

The disclosed implement system 114 includes a linkage structure 124 that cooperates with one or more hydraulic actuators 126 to move the work tool 118. In machines 110 having an internal pivot, the linkage structure 124 is pivotally connected at a first end to a frame 128 of machine 110, and pivotally connected at a second end to work tool 118. The internal pivot of the machine 110 may increase the maneuverability of the machine. In other embodiments, not shown, the machine 110 does not have an internal pivot and the linkage structure is connected to the frame in a fixed connection. In the disclosed embodiment, hydraulic actuators 126 include a single tilt cylinder and a pair of lift cylinders connected between work tool 118, the linkage structure 124, and/or frame 128 to dump/rack 156 (i.e., tilt) and raise/lower 152, 154 (i.e., lift) work tool 118, respectively. It is contemplated, however, that a greater or lesser number of hydraulic actuators 126 may be included within implement system 114 and/or connected in a manner other than described above, if desired. For example, hydraulic actuators may be provided that extend or retract the work tool 118 without moving the rest of the machine 110.

The powertrain 116 may be supported by the frame 128 of the machine, and may include an engine configured to produce a power output and a transmission that converts the power output to a desired ratio of speed and torque. The rotational power output may be used to drive a pump that supplies pressurized fluid to hydraulic actuators 126 and/or to one or more motors (not shown) associated with wheels 122 or tracks. The engine of powertrain 116 may be a combustion engine configured to burn a mixture of fuel and air, the amount and/or composition of which directly corresponds to the rotational power output. The engine of the powertrain 116 may be a battery able to provide rotational power output through an electric motor. The transmission of powertrain 116 may take any form known in the art, for example a power shift configuration that provides multiple discrete operating ranges, a continuously variable configuration, or a hybrid configuration.

Numerous different types of work tools 118 may be operatively attachable to a single machine 110 and driven by the powertrain 116. Work tool 118 may include any device used to perform a particular task such as, for example, a bucket, a fork arrangement, a blade, a shovel, or any other task-performing device. Although connected in the embodiment of FIG. 1 to lift and tilt relative to machine 110, the work tool 118 may alternatively or additionally rotate, slide, swing open/close, or move in any other manner known in the art. In the disclosed embodiment, work tool 118 is a bucket having a tip 130 configured to penetrate a material pile 200. As the contact with the material pile 200 is abrasive in nature, the work tool 118 may include a contact surface 119 configured to lead the contact with the material pile 200. The contact surface 119 may be, for example, a reinforced or hardened metal plate with higher durability than the rest of the work tool 118. The contact surface 119 may be sacrificial in nature, readily replaced as needed. In other embodiments, the contact surface may include teeth or prongs (not shown) to lead the contact of the work tool 118 with the material pile 200.

The machine 110 may be equipped with a plurality of machine sensors 138 that provide data indicative (directly or indirectly) of various operating parameters of the machine and/or the operating environment in which the machine is operating. The term "sensor" is meant to be used in its broadest sense to include one or more sensors and related components that may be associated with the machine 110 and that may cooperate to sense various functions, operations, and operating characteristics of the machine and/or aspects of the environment in which the machine is operating. The machine may include sensors 138 to detect, for example, a three-dimensional map of a material pile 200. The machine may include sensors 138 to detect, for example, a visual representation of the surrounding terrain of the work site 120 and/or to detect material piles. The machine may include sensors 138 to determine or identify a type of material at the work site 120 or in a material pile 200. The sensors 138 may include a radar, a 4D radar, a LIDAR, a camera, a stereocamera, or a 3D camera, as non-limiting examples.

The machine 110 may be controlled by an operator in a cab 132 of the machine. Alternatively or in addition, the machine may be controlled by a control system. The control system 145 (and thereby the machine) may be autonomous, semi-autonomous, or manually controlled. The control system 145 includes an electronic control module or controller 146 and a plurality of sensors (not shown). The controller 146 includes one or more processors and memory for storing computer instructions. The control system 145 may receive input signals from an operator operating the machine 110 from within cab 132 or remotely. The control system 145 may be configured to receive commands for the machine through a wireless communications system 136. The controller 146 may control the operation of various aspects of the machine 110 including the propulsion and steering system, and the drivetrain and hydraulic systems.

The controller 146 may be an electronic controller that operates in a logical fashion to perform operations, execute code configured to provide control algorithms, store and retrieve data, interface with networks, and other desired operations. The controller 146 may include or be configured to access memory, primary storage devices, secondary storage devices, processors, networks, and any other components for executing code. The memory and secondary storage devices may be in the form of read-only memory (ROM) or random access memory (RAM) or integrated circuitry that is accessible by the controller. Various other circuits may be associated with the controller 146 such as power supply circuitry, signal conditioning circuitry, control circuitry, driver circuitry, and other types of circuitry.

The controller 146 may be a single controller or may include more than one controller disposed to control various functions and/or features of the machine 110. The term "controller" is meant to be used in its broadest sense to include one or more controllers and/or microprocessors that may be associated with the machine 110 and that may cooperate in controlling various functions and operations of the machine. The functionality of the controller 146 may be implemented in hardware and/or software without regard to the functionality. The controller 146 may rely on one or more data maps relating to the operating conditions and the operating environment of the machine 110 and the work site 120 that may be stored in the memory associated with the controller. Each of these data maps may include a collection of data in the form of tables, graphs, and/or equations.

In some embodiments, the control system 145 and the controller 146 are located on the machine 110. In some embodiments, portions of the control system 145 are in a location remote to the machine, such as at a command center 300 or at a remote control unit. In such embodiments, the controller 146 may be configured to receive signals wirelessly from the control system 145 to operate the machine. The functionality of the control system 145 may be distributed so that certain functions are performed at machine 110 and other functions are performed remotely. In such case, the control system 145 may include a communications system such as wireless communications system 301 for transmitting signals between the machine 110 and the control system 145 or portions of the control system that are located remote from the machine. In an embodiment, a remote control unit positioned remote from the machine 110 may provide some or all of the specific commands that are then transmitted by the wireless communications system 301 to systems of the machine.

The control system 145 may include an additional system, such as a material detection system 148. The material detection system 148 may receive information from one or more sensors 138 to identify or assist in identifying material stored in a material pile. The material detection system may identify a type of material or other properties of the material, such as particle size distribution, average particle size, presence of fouling, moisture contents, etc. In some embodiments, the material detection system provides data from the sensors to an operator.

The implement load monitoring system 135 may include any of a variety of different types of implement load sensors depicted generally by an arrow in FIG. 1 as an implement load sensor system 133 to measure the load on the work tool 118. For example, the implement load monitoring system 135 may detect a mass of material held by the work tool 118 and/or or a volume of material held, based on a provided or detected material density. In one embodiment, the implement load monitoring system 135 may embody one or more pressure sensors 131 for use with one or more hydraulic cylinders 126 associated with the work tool 118.

Signals from the pressure sensor 131 indicative of the pressure within the hydraulic cylinders 126 may be monitored by the controller 146. Upon receipt of a signal indicating a substantial reduction in pressure within the secondary hydraulic cylinders 126, the controller 146 may determine that the load on the work tool 118 has been substantially reduced due to a portion of the material pile falling. Other manners of determining a reduction in cylinder pressure associated with a reduction in the load on work tool 118 are contemplated, including other manners of measuring the pressure within hydraulic cylinders 126 and measuring the pressure within other cylinders associated with the work tool 118. An increase in pressure indicative of an increase in load may be determined in a similar manner.

The implement load sensor system 133 may be used in part to determine when a material stockpiling operation has started or ended, and to provide a signal to the control system 145 to provide an indication regarding the operation to an operator. As provided herein, the indication provided by the control system 145 may be visual, auditory, tactile, or a combination of two or more thereof.

Stockpiling Operations

A stockpiling operation requires lifting portions of the material 205 in the material pile 200 towards the top of the pile, thereby increasing the height of the material pile and reducing the surface or ground area occupied by the material pile. The material is lifted by operation of the machine, sweeping material from the bottom and/or sides of the pile up toward the top using the work tool 118. Efficiently stockpiled material piles 200 are desirable to increase the available space at a given worksite. The lifting action may be repeated to further increase the space efficiency of the material pile 200, but at a cost of operator time, machine time, fuel, and wear and tear on the parts of the machine 110. Thus, it is desirable to increase the efficiency of stockpiling operations, such that costs of the stockpiling operation are minimized.

Figure 2:
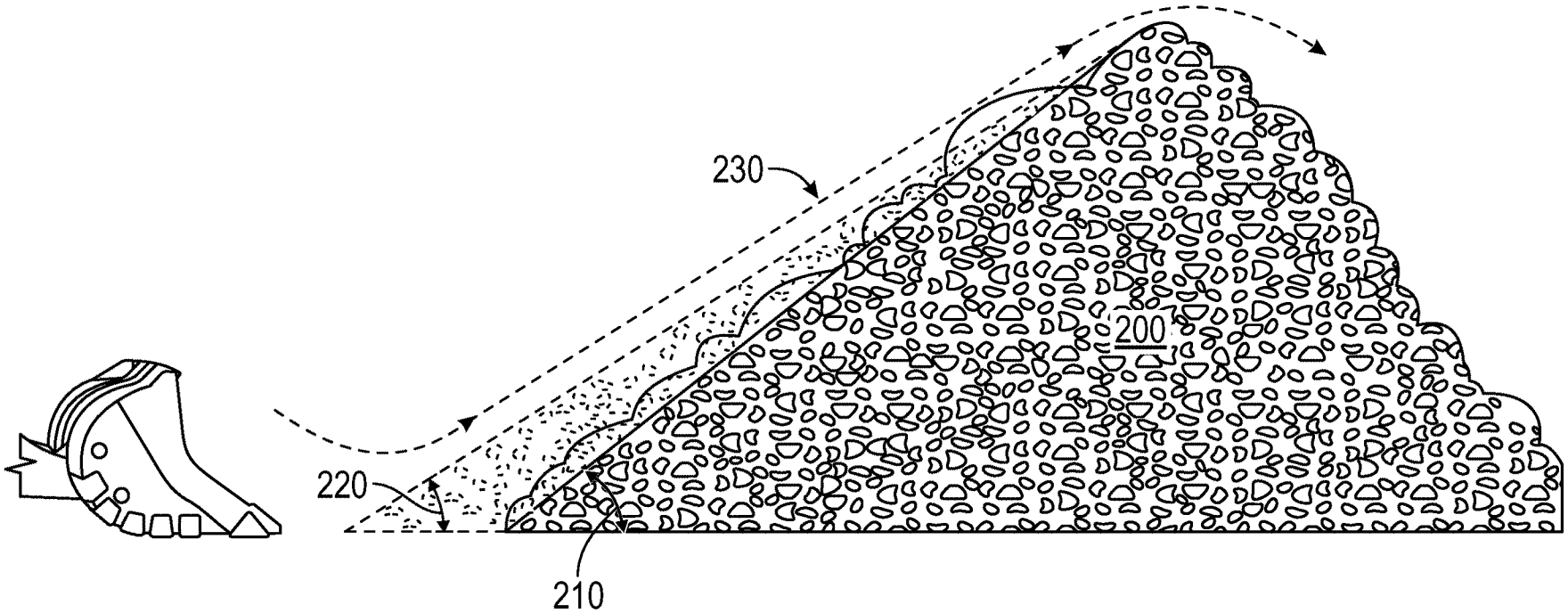
FIG. 2 is a diagram of a material pile, according to an embodiment.

The space efficiency of a material pile 200 is limited by how steep of an angle of repose the material can endure without falling. As illustrated in FIG. 2, a material pile may have an actual angle of repose 220 that is approximately the angle from horizontal of a leading edge of the material pile 200 to the apex of the material pile. A material pile 200 may also have a maximum or optimal angle of repose 210 that is the maximum angle that the material can be piled at without falling. While the angle of repose concept is illustrated in two dimensions in the figures, it can be extrapolated to a three dimensional space. The pile 200 may be conical in shape or may be an elongated triangular prism. Even in three dimensions, an optimal angle of repose 210 for a given material pile may be determined.

The optimal angle of repose 210 of a material pile 200 may depend on several factors, including the material type and composition, density, moisture content, average size of the material, material size distribution, granularity, smoothness of the material, and fouling. For example, materials having smooth shapes may have a shallower optimal angle of repose 210 than a material that has angular shapes. Higher moisture content may result in a steeper optimal angle of repose for a material, yet once a fluidity threshold is reached, the optimal angle of repose may decrease. Materials having a tighter size distribution may have a steeper optimal angle of repose than a material having a broad size distribution (and therefore particles that are relatively large and small). Fouling, such as through dust, may reduce the optimal angle of repose, as the fouling matter may act as a lubricant for the material, causing it to fall at shallower angles than cleaner material would. Fouling may also increase the optimal angle of repose, as it may act as a binder between the material particles, allowing the material pile to stand at steeper angles than a clean material pile would.

To increase the efficiency of a material stockpiling operation, herein is disclosed a method and system for determining the optimal angle of repose 210 for a material pile 200 and also determining an optimized travel path 230 for the work tool 118 of the machine 110 of the material pile such that, after the tool has passed through a portion of the material pile along the optimized travel path 230, the actual angle of repose of the material pile is substantially the same as the optimal angle of repose. The method and system is provided in additional detail.

Method of Optimizing Stockpiling Tool Path

Figure 3:
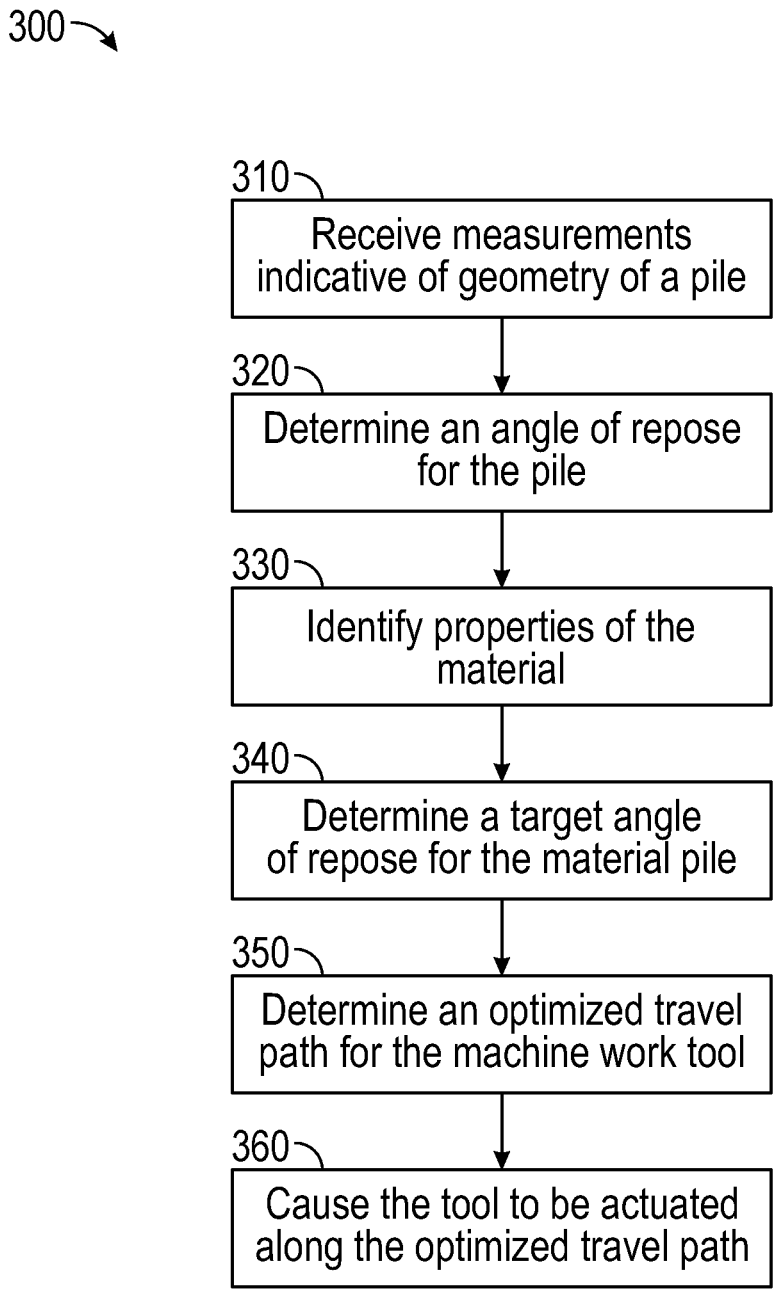
FIG. 3 is a flowchart showing a method of optimizing a stockpiling operation, according to an embodiment.

According to an aspect, provided herein is a method which determines an optimized tool path for a stockpiling operation. FIG. 3 provides a flowchart of one method of providing an optimizing a stockpiling operation, per an embodiment. The method 300 includes a receiving step 310 in which a control system receives measurements indicative of one or more geometric characteristics of the work site material, the work site material being inclusive of material in a material pile or otherwise present at a work site. Thus, the measurements may include measurements of material to be moved but will more particularly include material already positioned in a material pile. The control system may receive data from sensors or secondary sources that also includes general measurements of the work site which that machine is operating in. The measurements may be sufficient to permit the control system to generate a two- or three-dimensional map of the work site or of a material pile. In some embodiments, the measurements are sufficient for a control system to generate a 3D topographical map of an area of interest, whether of the work site or limited to one or more material piles. The material may be sand, dirt, sod, soil, gravel, rocks, stone, or any other material that must be moved at a work site or a combination of any two or more thereof. An operator may provide the measurements via an input provided to a control system. In some embodiments, one or more sensors provide the measurements. The sensors may be attached to the machine itself, or may be otherwise positioned at the work site. In other words, the sensors may be positioned on the machine or may be part of a sensor network remote from the machine, or a combination of both. The sensors may include cameras, stereocameras, 3D cameras, SONAR, LIDAR, radar devices, and 4D radar, as non-limiting examples. Combinations of sensors may also be used. In some embodiments, the one or more sensors scans the work site material periodically, such as once a minute, once every 15 seconds, or once a second.

In another step 320, an angle of repose of a material pile is determined according to the geometric characteristics of the pile. A user may provide an estimated angle of repose of the material pile via a user input device. An electronic control system may determine, by one or more processors, the angle of repose of the material pile based on the geometric characteristics of the material pile previously received, such as the height of the pile and a length of the pile at the top and bottom of the pile. In some embodiments, the control system may determine the angle of repose of the material pile by reference to a database having a table of materials at the worksite and their measured or estimated angles of repose, or the material piles' estimated mass, volume, density, and/or occupied area. The control system may determine the angle of repose of the material pile according to an average deviation of a projected angled surface of the material pile, the projected angle being a measure of the angle from the bottom of the pile to the top of the pile. Variations may include portions of the pile that are thinner or thicker. For example, the angle of repose may account for areas of the material pile that are thicker or thinner relative to a nominal angle of repose or the projected angle of repose. In some embodiments, the angle of repose is determined by finding the local minimum thickness present in the side of the material pile and extrapolating an angle of repose from that data. In other embodiments, the angle of repose of the material pile is determined according to the deviation of the angled surface of the material pile from the local maximum and/or minimum thickness. The determination of the angle of repose may apply a weighting to the deviations, giving greater weight to portions of the material pile that are thicker, or giving increased weight to areas that are thinner. The angle of repose may provide for a certain portion of the work site material to be moved into piles, through pile building and stockpiling operations, or may be limited to the material already present in the material pile.

In another step 330, properties of the material of the material pile are determined. These properties may include a type of material (e.g., sand, gravel, stone, etc.), and/or material size information. Material density and volume properties, fouling, and moisture content may also be provided or determined. An operator may provide the material properties or estimates thereof to the control system via an input. In some embodiments, material property data may be determined via a query to a maintained structured database. The control system may determine the material properties based on a location of the vehicle, for example, by cross-referencing the vehicle location with a structured database entry associated with a geofenced location that corresponds the vehicle location. In such a scenario, the structured database may contain data corresponding to material properties of the material in the material pile or piles in the geofenced location. The control system may cross reference the location of the machine or an indicated material pile with the data stored in the database. An operator may provide the identity or location of a material pile or the identity and/or properties of the material in a material pile, which the control system may cross reference with the database. The operator may provide an identity which may then be used to query a structured database for the needed data about the material or material pile needed to determine the target angle of repose. The operator may also provide information about the material in the pile directly, for example, by inputting a density and/or particle size of the material by a user input.

A target angle of repose for the material pile is determined in another step 340. The target angle of repose is determined by the control system according to the material properties of the material stored in the pile. In some embodiments, the control system determines the target angle of repose as a maximum sustainable angle of repose for the pile, based on the data provided to the control system. In some embodiments, the target angle of repose is less than the maximum, for example 95% or 80% of the maximum angle, such that a factor of uncertainty is built into the determination. Greater differences between a maximum angle of repose and the target angle of repose may account for uncertainty in the underlying data or may account for anticipated changes in conditions. When determining the target angle of repose, the control system may account for anticipated material movement operations, such as, but not limited to, stockpiling operations wherein material is moved within the pile to increase the area efficiency of the pile. The target angle of repose as determined by the control system may also account for anticipated material movement operations, such as, but not limited to, additional pile building or backstacking operations, in which additional material is added to the material pile. The control system may determine the target angle of repose based at least in part on the natural angle of repose, which may be determined or estimated according to the material properties. When determining the target angle of repose, the control system may also account for the difference between the natural angle of repose, determined according to the material properties, and the actual angle of repose. When the difference exceeds a predetermined threshold, multiple stockpiling operations may be required to reach the target angle of repose. For example, the mass or volume of material required to be moved in order to bring the angle of repose of the material pile to the natural angle of repose for the material (and thereby maximize the area efficiency of the material pile) should be considered when determining the target angle of repose. If the mass or volume of the material to be moved exceeds the capacity of the machine or the work tool to move in a single operation, multiple operations may be required. In such instances, a plurality of material movement operations are calculated to collectively result in the target angle of repose being achieved with intermediate targets being provided for each movement operation. The intermediate target angle of repose corresponds to a single material movement operation and is updated for each subsequent material movement operation.

The control system may provide indication of the target angle of repose to the operator of the machine. This information may be provided by a display in the machine or otherwise available to the operator, such as in the case of remote operation. In some embodiments, the target angle of repose is provided in the form of a digital or numerical display. In other embodiments, the indication of the target angle of repose is provided as a visual comparison between the actual angle of repose. In other embodiments, the indication is a visual overlay provided on a display of the material pile, whether a still or live image (such as provided by a video feed). The information may also be provided by haptic or audio feedback provided to the operator.

In another step 350, the control system determines an optimized travel path for the machine work tool. The control system may determine the optimized travel path according to the material properties and the target angle of repose of the material pile. The control system may determine the optimized travel path according to the volume or mass capacity of the work tool of the machine, so as to avoid overloading the machine. The optimized travel path may also be determined according to an upward carrying capacity of the machine and a total force capacity of the machine. For example, the control system may determine an optimized travel path that avoid overloading the volume or mass capacity of the work tool or exceeding the total force capability of the machine. The control system may also determine the optimized travel path according to a reach of the machine, i.e. how far the machine can reach to the top of the material pile without spilling the material from the work tool. The optimized travel path may also be determined according to high and/or low spots (maximum and minimum variations from an angle of repose) of the material pile, predicted or anticipated wear from the material on the material-engaging surfaces of the tool, and wear or strain on parts of the machine such as the hydraulic actuators and/or linkage.

The control system may determine the optimized travel path is such that the target angle of repose may be achieved by movement of the work tool. In other words, when the work tool follows the optimized travel path, the amount of variations in the surface of the material pile with respect to the target angle of repose may be reduced or eliminated. When the mass or volume of the material to be moved exceeds the mass or volume capacity of the tool to move in a single operation, multiple optimized travel paths may be determined. When multiple operations are required, the optimized travel paths may be determined to minimize the total number of operations or to not exceed a predetermined threshold of mass or volume of the material moved in a single operation. The mass or volume of the material moved in multiple movement operations associated with the optimized travel paths may be approximately evenly divided among the movement operations, or it may be unevenly divided among the operations. For example, when two material movement operations may be needed to achieve the target angle of repose, the control system may determine the optimized travel paths such that each associated material movement operation moves approximately the same amount of mass or volume of material. Alternatively, the control system may determine a first and second movement operation such that the first movement operation moves most of the mass or volume of the material and the the second movement operation "cleans up" any residual mass or volume of material to complete the stockpiling operation and achieve the target angle of repose.

The control system may provide an indication of the optimized travel path to the operator of the machine. The control system may provide this information by a display in the machine or otherwise available to the operator, such as in the case of remote operation. In some embodiments, the optimized travel path is provided in the form of a digital or numerical display. In other embodiments, the indication is a visual overlay provided by the control system on a display of the material pile, whether still or in real-time. The information may also be provided by the control system by haptic or audio feedback provided to the operator. For example, the control system may change or adjust a frequency or strength of an audio or haptic feedback to indicate to an operator how close the tool is to the optimized travel path or to indicate which direction the tool should move in order to better conform with the optimized travel path.

The various embodiments of the optimized travel path and any associated indicators should be understood to broadly encompass an assist to an operator for a wide variety of material moving operations. The optimized travel path may be any portion of a travel path determined to assist the operator with obtaining the desired target geometric characteristics or storage efficiency of the material pile. In some embodiments, the optimized travel path includes an initial contact position for the work tool associated with the machine, such as a point where the operator should engage the material pile with the work tool. Such a target point could assist an operator with forming a desired angle for the material while minimizing the chances of the material pile falling, as a non-limiting example. In some embodiments, the optimized travel path includes an initial contact angle for the work tool associated with the machine. The initial contact angle could be determined to reduce wear on the contact surfaces of the work tool. In some embodiments, the target angle of repose is an end contact position for the work tool, such as a point at which the operator should disengage with contacting the material pile. Such a target position may be useful to assist an operator with avoiding tipping a pile over during a stockpiling operation, as a non-limiting example. In some embodiments, the optimized travel path provides a position for the machine associated with the beginning of a current material movement operation, such that it indicates to the operator where to position the machine for the stockpiling operation such that the approach angle is correct. In some embodiments, the optimized travel path includes a position of the machine associated with the end of the current material movement operation, such that it indicates to the operator when to stop an operation. In some embodiments, the optimized travel path includes a position for the machine associated with the beginning or the end of a previous material movement operation, such that it indicates to an operator the position of the machine when they began or ended the previous operation so that the operator may adjust accordingly. In some embodiments, the optimized travel path includes a target angle of repose or natural angle of repose for the material pile.

The control system may provide the indication of the optimized travel path to the operator by a visual indication, an audible indication, a haptic indication, or a combination thereof. As non-limiting examples, the indication may be one of more of a light, a series of lights, a multi-color light, a periodic or persistent alarm, a tone, a display, and a display overlay. The control system may provide the indicator by haptic feedback to the operator. As a non-limiting example, the control system may cause the controls for the operator to vibrate or pulse as an indicator of a position or of the machine's proximity to the optimized travel path or in response to deviations from the optimized travel path. Other potential forms of haptic feedback include vibrations or pulses provided via wearable devices, such as headsets, vests, wrist wraps, or gloves, or provided by pedal or even the operator's seat.

In embodiments in which the indicator is provided at least partially in a visual form, the indicator may be a provided via a display observable by the user. The display may be in the cab of the machine (FIG. 1, 132). Alternatively, when the user is remotely operating the machine, the displays may be a portion of the user interface provided to the operator as are used by those skilled in the art. The visual indication may be one or more of a plane, a point, a line, a numerical display, or a text display. The visual indication may overlay a visual representation of the material pile. The visual indication may be a line or other visual feature indicating the optimized travel path as previously described. The visual indication may be displayed in a first-person perspective or in a third-person perspective, thereby displaying the visual indicator in relation to the machine 110.

In another step 360, the work tool is caused to be actuated along at least a portion of the optimized travel path. The actuation may include any possible movement of the work tool, including rack and tilt operations, raising and lowering operations, extending and retracting the tool, and/or opening and closing the work tool. The actuation may also include movement of the machine 110, such as moving closer to or farther from the material pile, or turning the machine to achieve a desired angle with respect to a surface of the material pile or other point.

The actuation may be performed by the operator, autonomously performed by a controller of the machine, or may be a mixture of autonomous and manual movements or actuations of the tool. The actuation may be carried out in response to an input from an operator or may be carried out while receiving an input from the operator. The actuation may be carried out in response to the machine being in a predetermined position or arriving in a predetermined position. The position may be absolute or may be relative to another object such as the material pile. The actuation may be carried out in response to the work tool contacting the material pile. For example, a controller could detect that the machine has contacted the material pile based on changes in the hydraulic lift cylinder pressure or the speed of the work tool, and the remaining actuation along the optimized travel path could be triggered by the controller.

Portions of the method can be repeated as needed to achieve the desired pile storage efficiency. Multiple passes with the tool may be required to achieve the desired efficiency, for example.

System

The machine 110 may also include one or more externally mounted sensors 138. Each sensor 138 may be a device that detects and ranges objects, for example a LIDAR (light detection and ranging) device, a RADAR (radio detection and ranging) device, a 4D radar, a SONAR (sound navigation and ranging) device, a camera device, a stereocamera, a 3d camera, or another device known in the art. With reference to FIGS. 1 and 2, a machine 110 may include a control system 145 that is configured to detect the location and/or shape (e.g., actual repose angle $\alpha$, 210) of the pile of material 200 (referring to FIGS. 1 and 2). The control system 145 may be configured to receive information from the sensors 138, controller 146, and/or material detection system 148. The control system may include or may interface with a communication device, a travel speed sensor, and other sensors on the machine, such as load sensors. The controller 146 may be in communication with each of the other components of the machine 110 and may be configured to autonomously actuate different functions of the machine, such as actuation of the work tool 118 and/or movement of the machine 110 itself.

The controller 146 may embody a single microprocessor or multiple microprocessors (processors) that include a means for monitoring operations of the machine 110, communicating with an offboard or remote entity, and detecting properties of material 205. For example, the controller 146 may include a memory, a secondary storage device, a clock, and one or more processors, such as a central processing unit or any other means for accomplishing a task consistent with the present disclosure. Numerous commercially available microprocessors can be configured to perform the functions of controller 146. It should be appreciated that the controller 146 could readily embody a general machine controller capable of controlling numerous other machine functions. Various other known circuits may be associated with controller 146, including signal-conditioning circuitry, power supply and conditioning circuitry, communication circuitry, and other appropriate circuitry.

Figure 4:
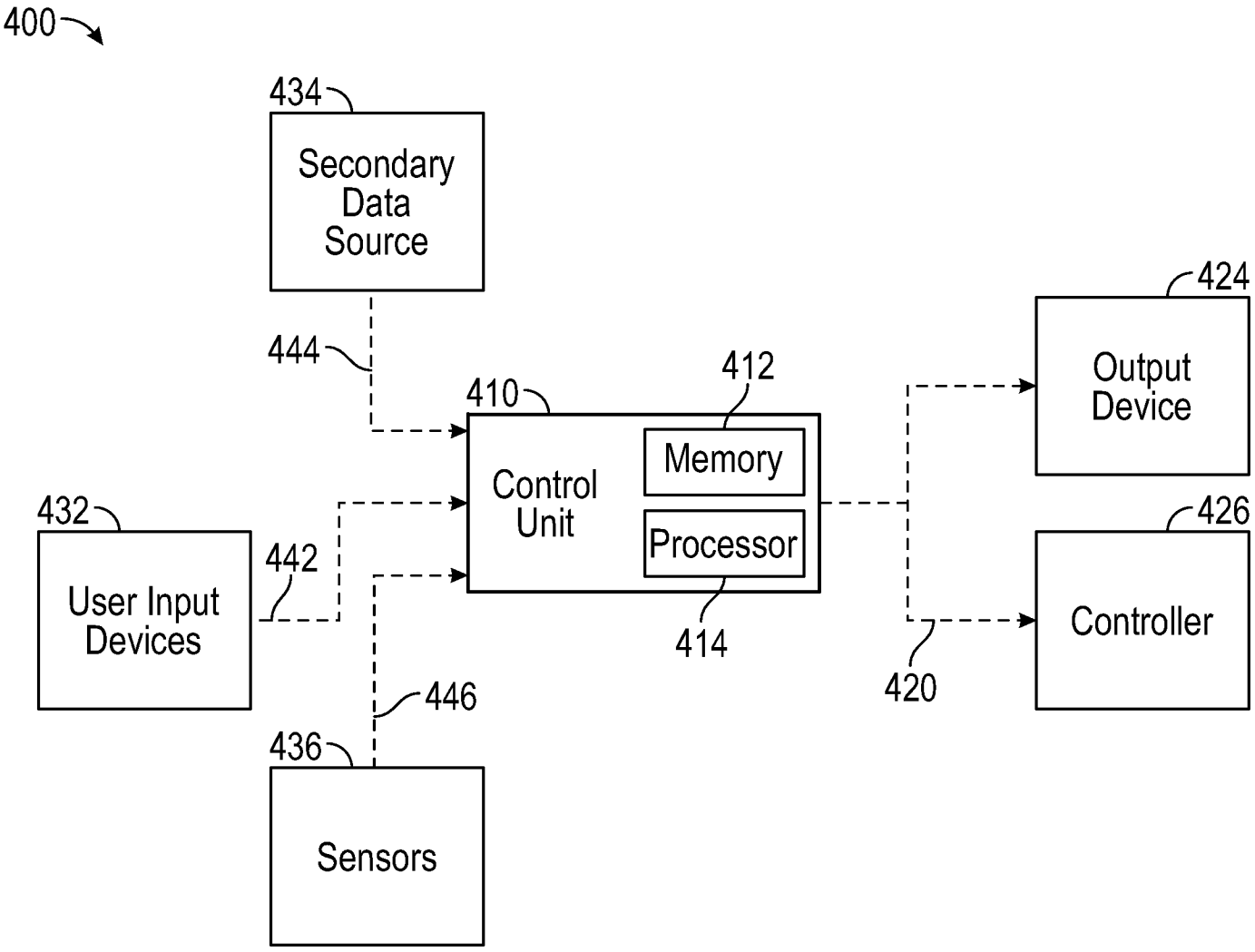
FIG. 4 is a schematic illustration of a control system, according to an embodiment.

FIG. 4 shows a diagram of a representative control 400 system including a controller or control unit 410 that may be used to control the machine. Such a control system 400 may also be used to carry out the method of determining and optimizing the angle of repose of material piles, as described herein. A control system may assist an operator in reducing the number of operations required to form piles of material at optimal repose angles and may assist the operator in maximizing the space efficiency of said piles.

In one embodiment, as illustrated in FIG. 4, the control system 400 may include a control unit 410 having one or more processors 414 and a computer memory 412 usable to implement the present disclosure. The computing system can be implemented, for example, as a consumer device such as a smartphone, other mobile phone, tablet computer, wearable computing device (e.g., smart watch, eyeglasses, head wearable display), desktop computer, laptop computer, or implemented with distributed computing devices. In some embodiments, the control unit 410 is the computing system. In other embodiments, the computing system is a portion or subsystem of the control unit 410. In some embodiments, the computing system may include conventional computer components such as one or more processors 414, storage device or computer memory 412, network interface, user input devices 432, and various user output devices 420 726.

A network interface coupled to or otherwise in communication with the computer system can provide a connection to a wide area network (e.g., the Internet) to which WAN interface of a remote server system can also be connected. Network interface can include a wired interface (e.g., Ethernet) and/or a wireless interface implementing various RF data communication standards such as Wi-Fi, Bluetooth, UWB, or cellular data network standards (e.g., 3G, 4G, 5G, 60 GHz, LTE, etc.).

User input devices 432 can include any device (or devices) via which a user can provide signals to the computing system; computing system can interpret the signals as indicative of particular user requests or information. The user input device can include any or all of a keyboard, touch pad, touch screen, mouse or other pointing device, scroll wheel, click wheel, dial, button, switch, keypad, microphone, sensors (e.g., a motion sensor, an eye tracking sensor, etc.), pedals, levers, and so on.

In some embodiments, sensors 436 provide measurements or signals 446 to the control unit 410 that provide information about the environment around the machine or about the geometry or other properties of a material pile. The sensors 436 may be located on the machine or may be remote to the machine or may be a combination of sensors on the machine and remote sensors. The sensors may be one or more of a camera, a stereocamera, a 3D camera, a SONAR, a LIDAR, a 4D radar, or a combination thereof.

The control system 400 may also include one or more secondary data sources 434 configured to provide data 444 to the control unit 410. The secondary data source 434 may, for example, provide information on the work site, such as the work site boundaries, locations of material piles, types of materials stored in various locations of the work site, or weather conditions. For example, the secondary data source may be computer memory storing a database that may be queried for the desired data.

The control system 400 is configured to determine, through the execution of code, properties of the material of a material pile. The material properties may be provided in part or in whole by an operator or user through input devices 432. The material properties may be based on data 444 446 provided by the sensors 436 and/or secondary data sources 434. The secondary data source 434 may provide data on the material properties, such as the material composition, density, size distribution, fouling levels, moisture content, etc. The secondary data source 434 may provide this data associated with a particular material pile based on the location of the material pile or the machine's location or bearing relative to a material pile (i.e., while facing or proximal to a given material pile), or in response to a request from the control unit 410. The secondary data source 434 may store the data in any usable format, such as a callable variable, a searchable index, a lookup table, a structured database, etc.

In some embodiments, the control system 400 is configured to execute code that, when executed, determines geometric characteristics for the work site or for material piles (such as angle of repose of the material pile) based on data 444 446 provided by the sensors 436 and/or secondary data sources 434, and/or user inputs 442 provided by the user via one or more user input devices 432. The control system 400 may be configured to determine actual geometric characteristics, such as the angle of repose, and target geometric characteristics of the material piles. In some embodiments, the control system 400 is configured to determine actual geometric characteristics of the material piles while target geometric characteristics are otherwise provided to the control system. In some embodiments, the control system 400 is configured to determine target geometric characteristics of the material piles while the actual geometric characteristics are otherwise provided to the control system.

The control system 400 may be further configured to determine, through the execution of code, a difference between the actual and target angle of repose for a material pile. The difference may be absolute or relative. It may be limited to a portion of the material pile, such as a particular volume, area, line, or point, or it may consider all of the material pile.

The control system 400 is further configured to determine an optimized travel path for the work tool target. The optimized travel path may be any point position or movement path determined to assist the operator with obtaining the desired target angle of repose or pile storage efficiency, and is determined to do so in an efficient manner. In some embodiments, the optimized travel path includes an initial contact position or angle for a tool associated with the machine, such as a point where the operator should engage the material with the leading edge of the work tool. In some embodiments, the optimized travel path includes an end contact position for the tool, such as a point at which the operator should disengage with contacting the material pile. Such a target position may be useful to assist an operator with avoiding tipping a pile over or avoid dumping material from the work tool during a stockpiling operation, as a non-limiting example. In some embodiments, the optimized travel path includes a position for the machine associated with the beginning of a current material stockpiling operation, such that it indicates to the operator where to position the machine for the operation. In some embodiments, the optimized travel path includes a position of the machine associated with the end of the current material stockpiling operation, such that it indicates to the operator when to stop an operation. In some embodiments, the optimized travel path includes a position for the machine associated with the beginning or the end of a previous material stockpiling operation, such that it indicates to an operator the position of the machine when they began or ended the previous operation so that the operator may adjust accordingly. In some embodiments, the optimized travel path includes a target angle of repose for the material pile.

The control system 400 may be configured to determine the optimized travel path periodically, or in response to an input provided to the system, or in response to the machine completing an operation or arriving at a predetermined location or achieving a predetermined position or bearing with respect to a material pile. The control system 400 may update the determination of the optimized travel path when the machine arrives at a target position. The control system 400 may update the optimized travel path when a material movement operation, such as, but not limited to, stockpiling operation, has been completed. The control system 400 may update the optimized travel path when a user request, via a user input device 432 for the control system 400 to determine a new optimized travel path. The control system 400 may update the target position in response to a change in a parameter or measurement, as provide by the sensors 436 or the secondary data sources 434.

The control system 400 may be configured to provide an indication of the optimized travel path to an operator of the machine. Various user output devices 424 can include any device via which the control system can provide information to a user. For example, the user output devices can include an audio device 424 to provide audible signals to a user, such as a speaker or whistle.

The control system 400 may be configured to provide a signal 420 to a controller 726 to control some or all of the functions of the machine and the associated work tool. In this way, the actuation of the work tool along with optimized travel path may be semi-autonomous or completely autonomous. The signals may correspond to movements of the machine or movements and/or actuations of the work tool, such as tilting, extending, etc. as previously described and may cause the controller to effect those movements and/or actuations. When operating semi-autonomously, the control unit 410 may require ongoing, confirmatory operation signal from the user to perform actuate the work tool. The control unit 410 may send the signals 420 to the controller 726 in response to the machine reaching a predetermined location or bearing, either an absolute location or one relative to a material pile (e.g., when the machine is a predetermined distance to a material pile or when the machine is turned to face a particular material pile). The control unit 410 may send these signals to the controller 726 in response to contact with the material pile. For example, the control unit 410 may determine that the work tool has contacted the material pile through sensors 436, such as hydraulic pressure sensors, and may send signals to the controller 726 to then autonomously or semi-autonomously complete the actuation of the work tool.

Some implementations include electronic components, such as microprocessors, storage and memory that store computer program instructions in a computer readable storage medium (e.g., non-transitory computer readable medium). Many of the features described in this specification can be implemented as processes that are specified as a set of program instructions encoded on a computer readable storage medium. When these program instructions are executed by one or more processors, they cause the processors to perform various operation indicated in the program instructions. Examples of program instructions or computer code include machine code, such as is produced by a compiler, and files including higher-level code that are executed by a computer, an electronic component, or a microprocessor using an interpreter. Through suitable programming, processor can provide various functionality for the computing system, including any of the functionality described herein as being performed by a server or client, or other functionality associated with message management services.

It will be appreciated that the description of the computing system provided herein is illustrative and that variations and modifications to the configuration or implementation of the computer system are possible. Computer systems used in connection with the present disclosure can have other capabilities not specifically described here. Further, while the computing system is described with reference to particular blocks, it is to be understood that these blocks are defined for convenience of description and are not intended to imply a particular physical arrangement of component parts. For instance, different blocks can be located in the same facility, in the same server rack, on the same motherboard, or on the same circuitry. Further, the blocks need not correspond to physically distinct components. Blocks can be configured to perform various operations, e.g., by programming a processor or providing appropriate control circuitry, and various blocks might or might not be reconfigurable depending on how the initial configuration is obtained. Implementations of the present disclosure can be realized in a variety of apparatus including electronic devices implemented using any combination of circuitry and software.

As utilized herein with respect to numerical ranges, the terms "approximately," "about," "substantially," and similar terms generally mean +/−10% of the disclosed values, unless specified otherwise. As utilized herein with respect to structural features (e.g., to describe shape, size, orientation, direction, relative position, etc.), the terms "approximately," "about," "substantially," and similar terms are meant to cover minor variations in structure that may result from, for example, the manufacturing or assembly process and are intended to have a broad meaning in harmony with the common and accepted usage by those of ordinary skill in the art to which the subject matter of this disclosure pertains. Accordingly, these terms should be interpreted as indicating that insubstantial or inconsequential modifications or alterations of the subject matter described and claimed are considered to be within the scope of the disclosure as recited in the appended claims.

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

References herein to the positions of elements (e.g., "top," "bottom," "above," "below") are merely used to describe the orientation of various elements in the figures. It should be noted that the orientation of various elements may differ according to other embodiments, and that such variations are intended to be encompassed by the present disclosure.

The hardware and data processing components used to implement the various processes, operations, illustrative logics, logical blocks, modules, and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of the various embodiments is illustrative only. Additionally, any element disclosed in one embodiment may be incorporated or utilized with any other embodiment disclosed herein.

INDUSTRIAL APPLICABILITY

The present disclosure describes systems and methods for manually, semi-autonomously, or autonomously stockpiling material via a loading machine 110 such as a wheeled or tracked loader, or any other similar machine. Optimal piling of the material may be based on identification of the material and associated material properties. An optimal travel path for the work tool 118 of the machine 110 may be determined according to properties of the material and the geometry of the pile. Such systems and methods may be used to more efficiently stockpile the material using the loading machines 110 by ensuring that the material pile is stored at or near an optimal angle of repose in a reduced number of stockpiling operations, thereby reducing wear and tear on the machine parts.

What is claimed is:

1. A method of controlling a machine, the method comprising:

receiving, by one or more processors and from one or more sensors, measurements indicative of one or more geometric characteristics of a material pile;

determining, by the one or more processors, an actual angle of repose for a material of the material pile according to the geometric characteristics of the material pile;

identifying one or more material properties of the material;

determining, by the one or more processors, a target angle of repose for the material pile according to at least one of a maximum value of the actual angle of repose or the one or more material properties;

determining, by the one or more processors, an optimized travel path for a tool through a portion of the material pile, according to the actual angle of repose and the target angle of repose for the material; and causing the tool to be actuated along at least a first portion of the optimized travel path, wherein the tool, when actuated, engages a portion of the material of the material pile and lifts the portion of the material to a top of the material pile such that the remaining material of the material pile has an angle of repose that is substantially equal to the target angle of repose.

2. The method of claim 1, wherein identifying the one or more material properties comprises:

maintaining, by the one or more processors, a look-up table including a plurality of geofenced locations and material properties of corresponding material piles within the respective geofenced locations;

receiving, by the one or more processors, a location of the machine; and identifying, by the one or more processors, the one or more material properties by performing a lookup function of the location of the machine in the look-up table, to identify material properties of the material pile in a geofenced location closest to the location of the machine.

3. The method of claim 1, wherein the one or more material properties include at least one of a type of material, an average particle size of the material, a density of the material, a moisture content of the material, a natural angle of repose of the material, or a fouling factor.

4. The method of claim 1, wherein causing the tool to be actuated along at least the first portion of the optimized travel path comprises one or more of: moving the machine toward the material pile, moving the machine away from the material pile, detecting impact of the tool with the material pile, raising the tool, lowering the tool, determining at least one of a mass of material lifted by the tool or a volume of material lifted by the tool, tilting the tool in a first direction, tilting the tool in a second direction, opening an aperture of the tool, or closing the aperture of the tool.

5. The method of claim 1, wherein determining the optimized travel path for the tool is further based on a weight capacity of the tool and a density of the material, wherein the optimized travel path for the tool is determined such that a mass of the material lifted by the tool does not exceed the weight capacity of the tool.

6. The method of claim 1, wherein determining the optimized travel path for the tool is further based on a fill capacity of the tool and a density of the material, wherein the optimized travel path for the tool is determined such that a volume of the material lifted by the tool does not exceed the fill capacity of the tool.

7. The method of claim 1, wherein the optimized travel path for the tool is based on at least one of:

an upward carrying capacity of the tool and a total force capacity of machine;

a reach of the tool to lift the portion of the material to the top of the material pile without spilling the material;

low and high spots along a surface of the material pile;

wear from the material on material-engaging surfaces of the tool; or wear on a linkage of the machine.

8. The method of claim 1, further comprising displaying, via a display device to an operator of the machine, one or more of the target angle of repose, the type of material, or the optimized travel path.

9. The method of claim 1, further comprising:

determining, using the one or more processors, an updated actual angle of repose for the material after the tool has traveled along the first portion of the optimized travel path;

determining, using the one or more processors, a second optimized travel path according to the updated actual angle of repose for the material; and causing the tool to be actuated along at least a portion of the second optimized travel path.

10. The method of claim 1, wherein the machine is a front loader and the tool is a bucket coupled to the front loader.

11. The method of claim 1, wherein the measurements indicative of the one or more geometric characteristics of the material pile are derived from a three-dimensional representation of the material pile generated by one or more of a camera, a stereocamera, or a LIDAR system.

12. The method of claim 1, wherein determining the optimized travel path for the tool includes determining an impact point and depth on the material pile for the tool.

13. A system comprising:

a control circuit comprising one or more processors and memory structured to store instructions that, when executed by the one or more processors, cause the control circuit to:

receive, by one or more processors, measurements from a sensor indicative of one or more geometric characteristics of a material pile;

determine, by the one or more processors, an actual angle of repose for a material of the material pile according to the geometric characteristics of the material pile;

identify, by the one or more processors, one or more material properties of the material;

determine, by the one or more processors, a target angle of repose for the material pile according to the one or more material properties;

calculate, by the one or more processors, an optimized travel path for a tool through a portion of the material pile according to the actual angle of repose and the target angle of repose for the material; and cause the tool to be actuated along at least a first portion of the optimized travel path, wherein the tool, when actuated, engages a portion of the material of the material pile and lifts the portion of material to a top of the material pile such that the remaining material of the material pile has an angle of repose that is substantially equal to the target angle of repose.

14. The system of claim 13, wherein the control circuit is configured to identify the one or more material properties by:

maintaining, by the one or more processors, a look-up table including a plurality of geofenced locations and material properties of corresponding material piles within the respective geofenced location;

receiving, by the one or more processors, a location of the material pile; and identifying, by the one or more processors, the one or more material properties by performing a lookup function of the location of the material pile in the look-up table, to identify material properties of the material pile in a geofenced location closest to the location of the material pile.

15. The system of claim 13, wherein the one or more material properties include at least one of a type of material, an average particle size of the material, a density of the material, a natural angle of repose of the material, a moisture content of the material, or a fouling factor.

16. The system of claim 13, wherein the control circuit causing the tool to be actuated along at least a portion of the optimized travel path includes one or more of: moving a machine carrying the tool toward the material pile, moving the machine carrying the tool away from the material pile, detecting impact of the tool with the material pile, raising the tool, lowering the tool, determining a mass of material lifted by the tool, tilting the tool in a first direction, tilting the tool in a second direction, opening an aperture of the tool, or closing the aperture of the tool.

17. The system of claim 13, wherein the control circuit is further configured to determine the optimized travel path for the tool based on a weight capacity of the tool and a density of the material, wherein the optimized travel path for the tool is determined such that a mass of the material lifted by the tool does not exceed the weight capacity of the tool.

18. The system of claim 13, wherein the control circuit is further configured to determine the optimized travel path for the tool based on a fill capacity of the tool and a density of the material, wherein the optimized travel path for the tool is determined such that a volume of the material lifted by the tool does not exceed the fill capacity of the tool.

19. The system of claim 13, wherein the sensor is one or more of a camera, a stereocamera, or a LIDAR system.

20. The system of claim 13, wherein the tool is a bucket of a front loader.

21. A system comprising:

a tool configured to lift a material from a material pile;

a sensor configured to measure an actual angle of repose of the material pile;

a control circuit comprising one or more processors and memory structured to store instructions that, when executed by the one or more processors, cause the control circuit to:

receive, by one or more processors from one or more sensors, measurements indicative of one or more geometric characteristics of a material pile;

determine, by the one or more processors, an actual angle of repose for a material of the material pile according to the geometric characteristics of the material pile;

identify one or more material properties of the material;

determine, by the one or more processors, a target angle of repose for the material pile according to the one or more material properties;

calculate, by the one or more processors, an optimized travel path for a tool through a portion of the material pile according to the actual angle of repose and the target angle of repose for the material; and cause the tool to be actuated along at least a first portion of the optimized travel path, wherein the tool, when actuated, engages a portion of the material of the material pile and lifts the portion of material to a top of the material pile such that the remaining material of the material pile has an angle of repose that is substantially equal to the target angle of repose.

22. The system of claim 19, wherein the tool is coupled to a vehicle and the control circuit is not coupled to the vehicle.

* * * * *